US008938929B2

(12) United States Patent
Engström

(10) Patent No.: US 8,938,929 B2
(45) Date of Patent: Jan. 27, 2015

(54) SET OF PANELS WITH CLIP

(75) Inventor: Nils-Erik Engström, Trelleborg (SE)

(73) Assignee: Pergo (Europe) AB, Trelleborg (SE)

( * ) Notice: Subject to any disclaimer, the term of this patent is extended or adjusted under 35 U.S.C. 154(b) by 0 days.

(21) Appl. No.: 13/483,974

(22) Filed: May 30, 2012

(65) Prior Publication Data

US 2013/0152500 A1 Jun. 20, 2013

Related U.S. Application Data

(60) Provisional application No. 61/576,129, filed on Dec. 15, 2011.

(51) Int. Cl.
*E04B 2/00* (2006.01)

(52) U.S. Cl.
USPC ..... 52/586.2; 52/591.1; 52/592.1

(58) Field of Classification Search
CPC ..... E04F 15/02038; E04F 15/02; E04F 15/04; E04B 5/00
USPC ..... 52/309.1, 309.13, 582.1, 582.2, 588.1, 52/586.1, 586.2, 591.1, 592.1; 403/364, 403/339
See application file for complete search history.

(56) References Cited

U.S. PATENT DOCUMENTS

| | | | | |
|---|---|---|---|---|
| 7,726,088 | B2 * | 6/2010 | Muehlebach | 52/582.1 |
| 7,980,039 | B2 * | 7/2011 | Groeke et al. | 52/582.2 |
| 8,220,217 | B2 * | 7/2012 | Muehlebach | 52/582.1 |
| 8,621,814 | B2 * | 1/2014 | Cappelle | 52/582.1 |
| 2007/0006543 | A1 * | 1/2007 | Engstrom | 52/582.1 |
| 2008/0110125 | A1 * | 5/2008 | Pervan | 52/582.2 |
| 2009/0217615 | A1 * | 9/2009 | Engstrom | 52/588.1 |
| 2010/0043333 | A1 * | 2/2010 | Hannig | 52/582.2 |
| 2011/0173914 | A1 * | 7/2011 | Engstrom | 52/582.2 |
| 2011/0271631 | A1 * | 11/2011 | Engstrom | 52/582.2 |
| 2011/0271632 | A1 * | 11/2011 | Cappelle et al. | 52/582.2 |

FOREIGN PATENT DOCUMENTS

| | | |
|---|---|---|
| EP | 2 017 403 | 1/2009 |
| EP | 2 034 106 | 3/2009 |
| EP | 2 233 195 | 6/2011 |

(Continued)

OTHER PUBLICATIONS

International Search Report for Application No. PCT/EP 2012/005099 dated Apr. 2, 2013.

*Primary Examiner* — Adriana Figueroa
(74) *Attorney, Agent, or Firm* — Jenkins, Wilson, Taylor & Hunt, P.A.

(57) ABSTRACT

The present subject matter relates to a set of panels, in particular floor panels, including a first panel and at least one second panel, wherein the panels have a first edge and a second edge;

the first edge and the second edge are configured to establish a connection between the first and the second panels;

the first edge includes a lower lip with a step;

the second edge includes a downwardly open locking groove, which in a connected state of the panels, or of the edges, cooperates with the step and ensures a lock in a horizontal direction;

the connection can be established by a vertical relative movement of the panels with respect to each other;

a separate clip is provided which is disposed on the first edge and includes a movable clip head and a clip base.

9 Claims, 2 Drawing Sheets

(56) References Cited

FOREIGN PATENT DOCUMENTS

| | | |
|---|---|---|
| WO | WO 2007/008139 | 1/2007 |
| WO | WO 2007/089186 | 8/2007 |
| WO | WO 2010/136171 | 12/2010 |
| WO | WO 2011/012104 | 2/2011 |
| WO | WO 2011/085788 | 7/2011 |

* cited by examiner

SET OF PANELS WITH CLIP

CROSS-REFERENCE TO RELATED APPLICATIONS

This application claims the benefit of and priority to U.S. Provisional Application No. 61/576,129, filed Dec. 15, 2011 and German Patent Application No. 10 2011 056 494.2, filed Dec. 15, 2011, the entire disclosures of which are herein incorporated by reference.

TECHNICAL FIELD

The present subject matter relates to a set of panels, in particular floor panels, which comprise a first panel and at least one second panel.

BACKGROUND

WO 2007/008139 A1 discloses flooring panels respectively provided with a first and a second edge, wherein these edges are designed to establish a connection between the panels. In this case, the first edge comprises a lower lip with a step that cooperates with an open locking groove of the second edge in order to ensure a lock in a horizontal direction.

A separate clip disposed on the first edge and comprising a movable clip head and a clip base is provided for locking in the vertical direction. In a locking position, the clip head, in the connected state of the panels, cooperates with a blocking surface on the second edge, whereby the panels are locked in the vertical direction. The clip base serves for pressing the clip head into its locking position during the establishment of the connection. In this case, the clip case cooperates with an activating surface of the second edge. In this case, the connection between the first and the second edges can be established by a vertical relative movement of the panels with respect to one another. In the process, the second edge, or the panel with the second edge, is pressed in a downward direction until the step of the lower lip reaches into the downwardly open locking groove. During this downward movement of the second edge, the activating surface presses against the clip base, which in turn ensures that the clip head arrives in its locking position.

During transport or installation, the separate clips in the panels of WO 2007/008139 can fall out of the grooves provided for accommodating them. This makes the installation more difficult because attention must constantly be paid to the clips not falling out. On the other hand, the clips could be pressed with a certain oversize into the grooves provided for accommodating them during the production of the panels, which would counteract the clips falling out inadvertently. However, there is then the danger of the clips not being lodged freely movably in their grooves any longer, so that the desired vertical locking action no longer takes place when the panels are connected.

Therefore, the present subject matter is based on the object of providing a set of panels with which installation can be carried out easily and in which a vertical lock between connected panels takes place as reliably as possible.

SUMMARY

The object on which the present subject matter is based is achieved with the combination of features according to the independent claims. Preferred exemplary embodiments are apparent from the dependent claims.

The set of panels according to the present subject matter is characterized in that the clip has a fixed fastening part, a flexible connection area and a movable clip portion which comprises the clip base and the clip head. The fastening area is firmly or immovably connected to the first edge. The flexible connection area connects the connection part with the movable clip portion. In this case, the flexibility of the connection area is dimensioned in such a way that the movable clip portion can be moved sufficiently easily for the requirements of an easy installation, in particular a vertical lock. On the other hand, the connection area has to ensure that the movable clip part does not yield during the establishment of the connection between the first and second edges, but that it only executes the movements intended for it.

Thus, a clip is disclosed which comprises a clip head and a clip base, the clip base being designed to be put under pressure by the second edge when the two edges are being connected, so that the clip head introduces a force into the movable clip portion which presses the clip head into its locking position. Here, the term "press" it to be understood in the sense that a force is applied to the clip head that is introduced by the clip base into the movable clip portion and ensures that the clip head arrives in its locking position. In the clip, the capacities for being fastened and for moving are functionally separated by the division into the fastening part, the connection area and the movable clip portion.

In a preferred exemplary embodiment, the fastening part is lodged in a fastening groove of the first edge. In this case, the fastening part can be glued into the fastening groove and/or retained therein by an interference fit. Moreover, the fastening groove can comprise an undercut so that the fastening part grasps behind it, whereby it is no longer possible to pull the fastening part out of the fastening groove, for example in the horizontal direction. In this case, the fastening part can comprise latching means that cooperate with the undercut of the fastening groove.

In a preferred exemplary embodiment, the movable clip portion comes directly into contact with the first edge only by means of the clip head. This means that the movable clip portion is supported only by the first edge, or by a surface associated with the first edge, and is otherwise retained only by the connection area. In an alternative embodiment, the movable clip portion is held in position relative to the first edge only by the connection area. In that case, there is no direct contact of the movable clip portion with the first edge. The clip portion is connected to the first edge only indirectly, namely via the connection area and in the end via the fastening area.

Advantageously, the connection area is configured in such a way that, during the establishment of the connection between the first and second edges, the movable clip portion substantially rotates about an axis of rotation that is located in or in the vicinity of the connection area. The axis of rotation in this case extends parallel to the longitudinal extent of the first edge. When the movable clip portion rotates about this axis of rotation, the clip head can also have a translational motion component in addition to a rotational motion component. Thus, the movement of the movable clip portion is not necessarily exclusively a rotary movement, but is only marked by such a movement.

In a preferred exemplary embodiment, the clip head executes two movements in opposite directions when the connection between the first and second edges is established, with the activating surface of the second edge pressing the locking head first into an escape groove. Thereafter, the clip head is pressed in the opposite direction, caused by the forces of the activating surface acting on the clip base. In a preferred exemplary embodiment, an initial position of the clip head, i.e. prior to the establishment of the connection between the first and second edges, can thus substantially correspond to the locking position that is reached when the two edges are interconnected and the clip head performs the function of vertically locking the first and second edges that is intended for it.

In the locking position of the clip head, the clip can rest against the activating surface with the clip base. Thus, the movable clip portion can be under a certain tension. This tension can be ascribed to an elastic returning force that can arise while the connection of the two edges within the movable clip portion is established.

An upper mating edge of the first edge can define a vertical plane, with the step of the lower lip of the first edge and the axis of rotation, about which the clip head, rotates lying on a same side of the vertical plane. It is ajso possible that the step of the lower lip and the axis of rotation lie on different sides of the vertical plane, i.e. that in this case the vertical plane extends between the step of the lower lip and the axis of rotation.

The activating surface of the second edge can be configured to be inclined relative to the vertical, curved and/or stepped. By means of the configuration of the activating surface, specific influence can be taken on the forces required for pressing the clip head into the escape groove, or to apply a force to the clip base to ensure that the clip head arrives in its locking position.

The panels can respectively comprise a third and a fourth edge that can be interconnected by means of a pivoting movement. It is thus possible to connect a panel by means of a pivoting movement simultaneously with an already laid row of panels and an already laid panel of a row that is being newly created, with the connection between the first and second edges being based on a scissor-like movement. In view of this, the feature of the first and second edges being connectable by means of a vertical relative movement of the panels with respect to one another is supposed to be understood to mean that a pivoting movement about the third edge of a panel is also comprised in the case of a scissor-like connection of the first and second panels. Alternatively, it is possible to configure the third edge analogously to the first and second edges, so that the panels can be interconnected by a purely vertical movement.

BRIEF DESCRIPTION OF THE DRAWINGS

The present subject matter is to be explained in more detail with reference to the exemplary embodiments shown in the figures. In the Figures.

DETAILED DESCRIPTION

Figure 1:
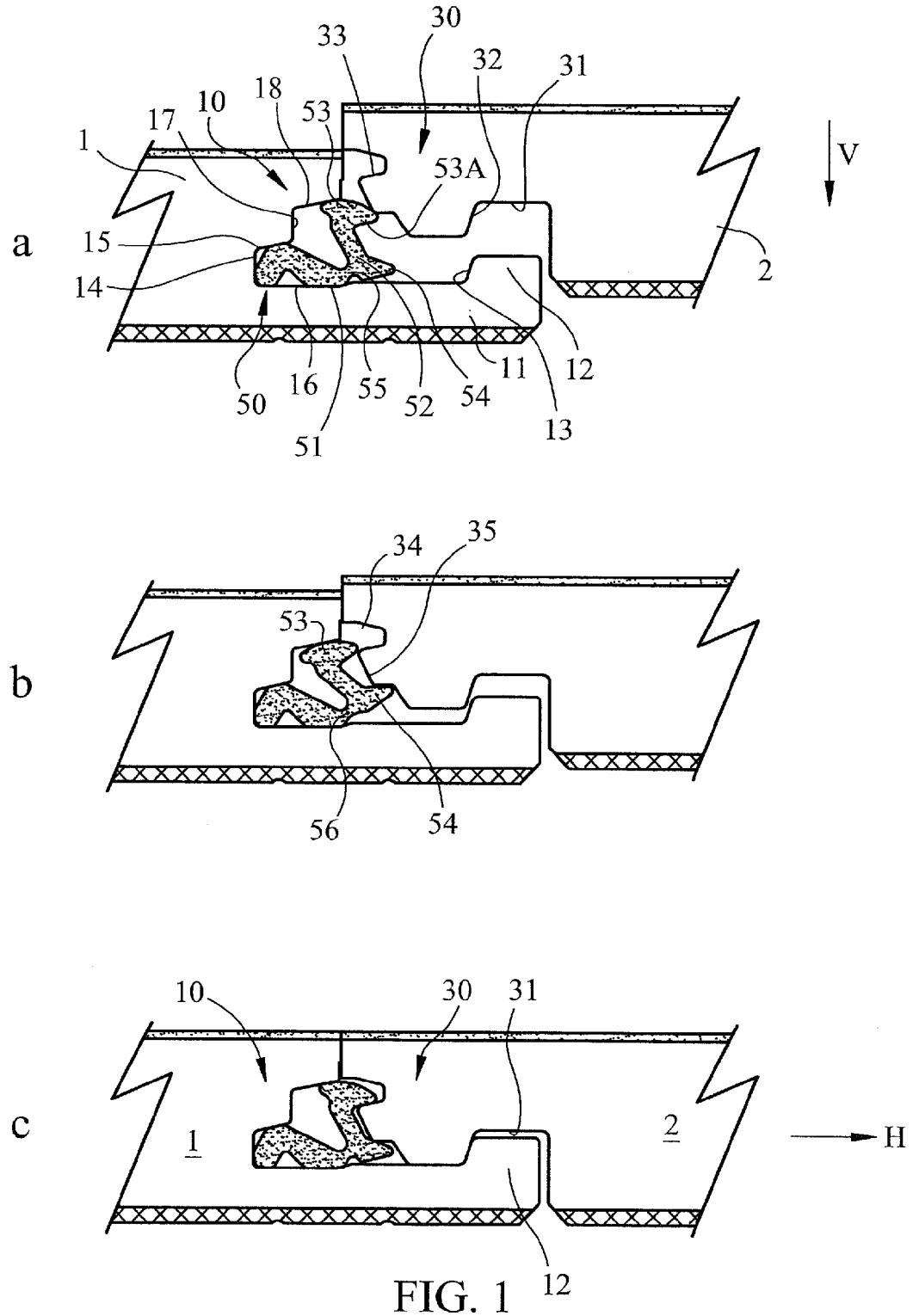
FIGS. 1*a* to 1*c* show a first exemplary embodiment of the subject matter.

FIGS. 1*a* to 1*c* show, in a section, a first panel 1 (shown partially) and a second panel 2 (shown partially). The first panel 1 comprises a first edge (10), whereas the second panel 2 comprises a second edge 30. The first panel 1 is supposed to also comprise the second edge 30 on an opposite side not shown here. The same applies, mutatis mutandis, to the second panel 2, which is supposed to comprise the first edge 10 on another side not shown here. The panels 1, 2 have a rectangular basic shape, with an edge length of the edges 10, 30 being, for example, between 10 and 40 cm.

As shown by FIGS. 1*a* to 1 *c*, the second edge 30 can be connected to the first edge 10 by means of a vertical downward movement in the direction of the arrow V. In this case, FIG. 1 *c* shows the edges 10, 30 in a connected state.

The first edge 10 comprises a lower lip 11 with a step 12. In the connected state of the edges 10, 30, the step 12 reaches into a downwardly open locking groove 31 of the second edge 30. A substantially vertical step locking surface 13 of the step 12 in the process cooperates with a substantially vertical groove side wall 32 of the locking groove 31. The step locking surface 13 and the groove side wall 32 in this case ensure that, in the connected state of the edges 10, 30, the latter cannot be pulled apart in the horizontal direction (see arrow H).

It should be noted here that the subject matter primarily relates to floor panels, but that wall panels or even ceiling panels are in principle also covered by the subject matter disclosed herein. The terms "vertical", "horizontal", "top", "bottom" are in this case supposed to respectively relate to floor panels that are usually laid in the horizontal plane on an underlying floor. However, if the panels are used as wall panels, the terms "vertical", "horizontal", "top", "bottom" are to be reinterpreted accordingly.

A clip, generally designated 50 is associated with the edge 10. The clip 50 comprises a fixed fastening part 51, which is partially disposed in a fastening groove 14 of the first edge 10. In this case, the fastening groove 14 comprises an upper groove wall 15 and a lower groove wall 16. The groove wall 15 and the groove wall 16 in this case extend substantially parallel to one another in the horizontal. In addition to the fixed fastening part 51, the clip 50 comprises a movable clip portion 52 which comprises a clip head 53 and a clip base 54. As FIG. 1 *c* shows, the clip head 53, with a substantially horizontal head locking surface 53A, rests against an also substantially horizontal blocking surface 33. The blocking surface 33 of the second edge 30 in this case constitutes a lower groove wall of a blocking groove 34 in the second edge 30. FIG. 1*a* shows the clip 50 in an initial position, whereas FIG. 1 *c* shows the clip 50 in a locking position. The initial position and the locking position can match each other, i.e. during the connection process, the clip 50, or the movable clip portion 52, substantially returns to its initial position.

The fixed fastening part 51 and the movable clip portion 52 are interconnected via a flexible connection area 55. When the connection between the first edge 10 and the second edge 30 is being established, which is done by pressing down the second edge 30, an activating surface 35 (see FIG. 1 *b*) presses against the clip head 53, whereby the latter is pressed, counterclockwise in the illustration of the FIGS. 1*a* to 1*c*, into an escape groove 17 of the first edge 10. The movable clip portion 52 is in a deflected position which recognizably deviates from the initial position and recognizably from the locking position. In this case, escape groove 17 comprises a substantially horizontally extending upper groove wall 18. This upper groove wall 18 can also extend in a curved manner or more strongly inclined relative to the horizontal. After the activating surface 35 has come into contact with the clip head 53, it comes into contact with the clip base 54 during the further course of pressing down the second edge 30. This causes the movable clip portion 52 to be rotated back clockwise after the first counterclockwise rotation (in the illustration of FIG. 1). As during the process of the clip head 53 escaping into the escape groove 17, the rotation takes place about an axis of rotation marked 56, which lies in the area of the flexible connection area 55. In the connected state of the two edges 10, 30, the clip head 53, on the one hand, rests against the groove wall 18 of the escape groove 17 and, on the other hand, against the locking surface 33, or the lower groove wall of the groove 34, of the second edge 30. Even if a small amount of play, which expediently is very small (<0.03 mm), is possibly provided, the clip head 53 ensures a lock of the edges 10, 30 in the vertical direction by cooperating with the surfaces 18, 33. Based on FIG. 1*c*, it is not possible to move the second panel 2 with its second edge 30 upwards relative to the first panel 1. In any case, the forces required for separating the panels 1, 2 in the vertical direction would be so large that they damage the edges 10, 20 or deform them so permanently, that their holding forces are decreased significantly.

As is apparent from the FIG. 1*c*, or the FIG. 1*a*, the movable clip portion 52 rests directly against the first edge 10 only with its clip head 53. An indirect connection of the movable clip portion 52 is effected via the flexible connection area 55 and via the fixed fastening area 51.

The flexible fastening area 55 is configured in such a way that a rotation about the axis of rotation 56 is possible in a sufficiently simple manner. The fastening area 51 in cooperation with the fastening groove 16 of the first edge 10 ensures a firm connection of the clip 50 to the first edge 10, so that the clip with its movable clip portion 52 is easy to move, but the clip 50 as such is well attached to the first edge 10.

FIGS. 2*a* to 2*c* show another exemplary embodiment of the present subject matter. Components or features of the exemplary embodiment of FIGS. 2*a* to 2*c* that are identical or similar to components or features of FIG. 1 are provided with the same reference numerals as in FIGS. 1*a* to 1*c*. With regard to the fundamental structure of the edges 10, 30 as well as of the clip 50, reference is made to the descriptions of FIGS. 1*a* to 1*c*.

In contrast to the exemplary embodiment of FIGS. 1*a* to 1*c*, the activating surface 35 in the exemplary embodiment of FIGS. 2*a* to 2*c* is not stepped, but configured as a curved surface slightly inclined to the horizontal. Also in this case, the activating surface 35, in a first phase during the establishment of the connection of the edges 10, 30, presses against the clip head 53, which is thus being pivoted about the axis of rotation 56 into the escape groove 17. FIG. 2*b* shows the clip head 53 as it is almost completely received by the escape groove 17. It is further apparent from FIG. 2*c* that the activating surface 35 now cooperates with the clip base 34, wherein a force now acts on the clip base 34 due to the second panel 2 further being pressed down, which has the movable part 52 of the clip 50 rotate in the opposite direction, i.e. in such a way that the clip head 53 is rotated back from the escape groove 17 in the direction of its original position, which is shown in FIG. 2*a*.

In analogy to FIG. 1*c*, FIG. 2*c* shows the panels 1, 2, or the edges 10, 30, in the connected state. By simultaneous abutting of the clip head against the locking surfaces 33 and 18, a lock of the edges 10, 30 in the vertical direction is provided.

Figure 2:
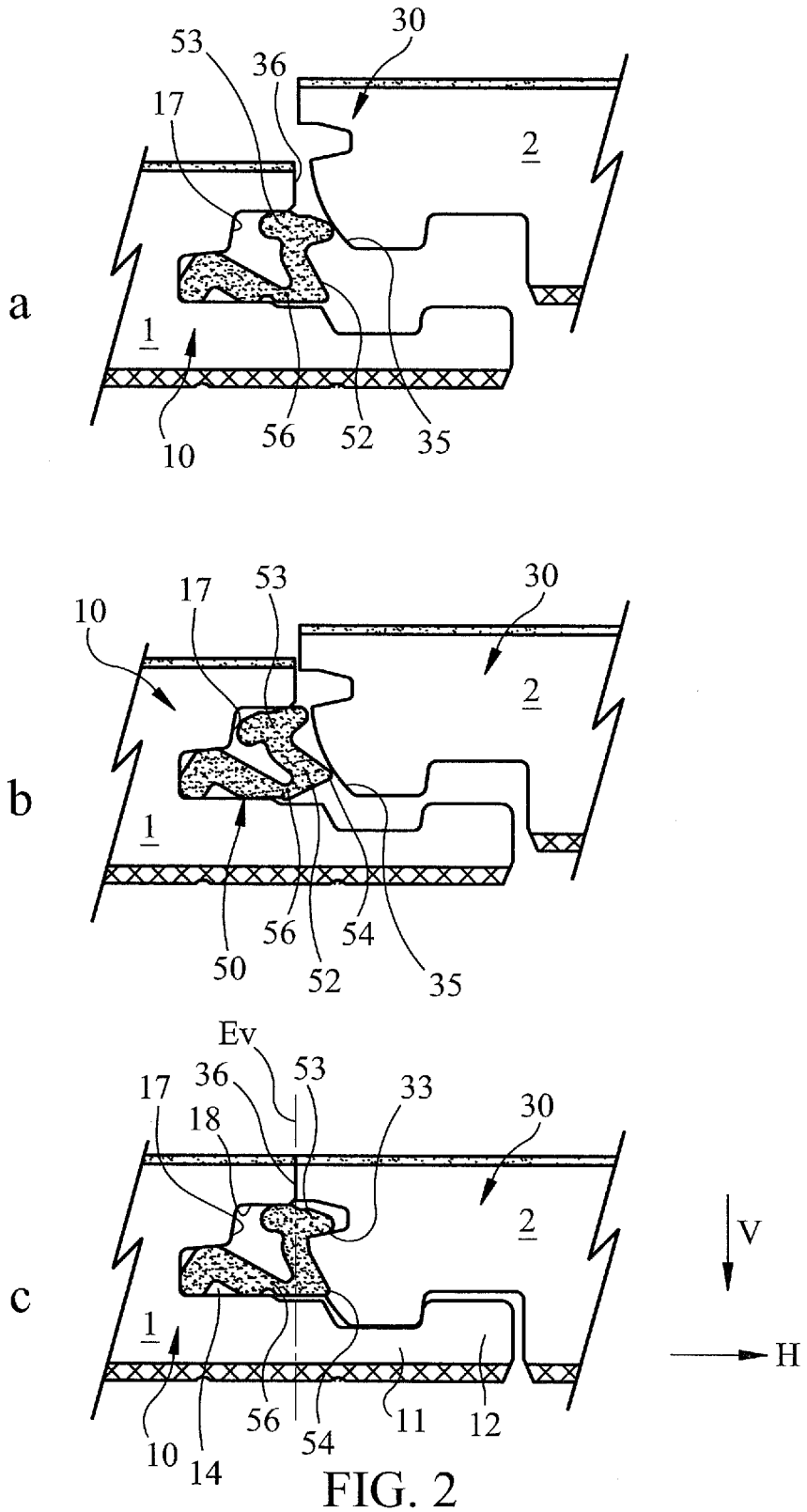
FIGS. 2*a* to 2*c* show a second exemplary embodiment of the subject matter.

It does not become clear from FIGS. 1 and 2 that the movable clip portion 52 can be deformed in itself during the establishment of the connection of the edges 10, 30. This means that the position of the clip head 53 relative to the clip base 54 can change when the second panel 2 is being pressed down. However, the rigidity of the movable clip portion 52 is considerably greater than the rigidity of the flexible connection area 55. The clip 50, or the activating surface 55, in cooperation with the locking groove 33 and their association with one another can therefore be designed in such a way that in the connected state of the edges 10, 30, the movable clip 52 is under tension, which is to be ascribed to elastic returning forces in the movable clip portion 52.

In addition to the force introduced into the clip base 54, a returning force provided by the elastic deformation in the connection area 55 supports the movement of the clip head 53 into the locking position while the second edge 30 is pressed downward. Thus, these forces supplement each other to result in a total force which has the clip head 53 snap into the blocking groove 34 securely.

FIG. 2*c* shows a dot-dash straight line that represents a vertical plane $E_v$. In this case, the vertical plane $E_v$ coincides with an upper mating edge 36 of the second edge. Whereas the step 12 lies to the right of the plane $E_v$ in the illustration of FIG. 2*c*, the axis of rotation 56, if only slightly, lies to the left of the plane E. The axis of rotation 56, as is the case in the exemplary embodiment of FIG. 1, can also lie on the same side of the step 12.

The fastening groove 14 and the escape groove 17 are laterally limited by the plane $E_v$. Computed from the plane $E_v$, the fastening groove 14 has a greater depth than the escape groove 17. The grooves 14, 17 can be placed in the core material of the panels 1, 2 by milling. The core material can be, for example, wood, plastic, a mixture of wood and plastic, MDF or HDF.

LIST OF REFERENCE NUMERALS

1 First panel
2 Second panel
10 First edge
11 Lower lip
12 Step
13 Step locking surface
14 Fastening groove
15 Upper groove wall
16 Lower groove wall
17 Escape groove
18 Upper groove wall
30 Second edge
31 Locking groove
32 Groove side wall
33 Blocking surface
34 Blocking groove
35 Activating surface
36 Upper mating edge
50 Clip
51 Fastening part
52 Movable clip portion
53 Clip head
54 Clip base
55 Flexible connection area
56 Axis of rotation

The invention claimed is:

1. A set of floor panels, the set comprising:

a first panel and at least one second panel, wherein:

each of the panels are respectively provided with a first edge and with a second edge;

the first edge and the second edge are configured to establish a connection between the first and the second panels;

the first edge comprises a lower lip with a step;

the second edge comprises a downwardly open locking groove, which in a connected state of the panels, or of the edges, cooperates with the step and is configured for locking in a horizontal direction; and a separate clip disposed on the first edge, the separate clip comprising:

a fixed fastening portion that is fixedly held during rotation within a fastening groove of the first edge, the fastening groove having an upper groove wall and a lower groove wall;

a movable clip portion comprising a clip head at a free extremity of the movable clip portion and a clip base, said movable clip portion having a back side and a front side, the back side being directed towards the inside of the first panel, the clip head having a protrusion extending towards and received within a blocking groove of the second edge of the second panel in the connected state;

the separate clip having a flexible connection, the flexible connection connecting the movable clip portion to the fixed fastening portion, wherein the clip head and the clip base are configured to rotate together between a first position and a second position about a rotation point formed by said flexible connection;

wherein the fixed fastening portion is located at the back side of the movable clip portion;

wherein the clip head, in the connected state, is in the second position and engages a blocking surface of the blocking groove and is configured for locking in a vertical direction of the first and second edges of the respective panels; and wherein in the connected state the second edge of the second panel also cooperates with said clip base so as to prevent any substantive rotation of the movable clip portion.

2. The set according to claim 1, wherein the fixed fastening portion is lodged in a fastening groove of the first edge.

3. The set according to claim 1, wherein the movable clip portion comes directly into contact with the first edge only with the clip head.

4. The set according to claim 1, wherein the second position comprises a locking position in which the clip head is disposed between each of the first and second edge.

5. The set according to claim 1, wherein the clip head executes two movements in opposite directions when an activating surface presses the clip head into an escape groove.

6. The set according to claim 1, wherein an upper mating edge of the first edge lies in a vertical plane, with the step of the lower lip and an axis of rotation lying on a same side of the vertical plane.

7. The set according to claim 1, wherein the panels respectively comprise a third and a fourth edge adapted to connect by a pivoting movement.

8. The set according to claim 1, wherein the movable clip portion has an upper end and a lower end, said clip head being located at the upper end and said flexible connection being located at the lower end.

9. The set according to claim 1, wherein said movable clip portion is urged towards the blocking surface of the second panel via said flexible portion connection.

* * * * *